US005812036A

United States Patent [19]

Estrada

[11] Patent Number: 5,812,036

[45] Date of Patent: Sep. 22, 1998

[54] DIELECTRIC FILTER HAVING INTRINSIC INTER-RESONATOR COUPLING

[75] Inventor: Anthony J. Estrada, San Diego, Calif.

[73] Assignee: Qualcomm Incorporated, San Diego, Calif.

[21] Appl. No.: 431,181

[22] Filed: Apr. 28, 1995

[51] Int. Cl.[6] ..... H01P 1/205

[52] U.S. Cl. ..... 333/202; 333/206

[58] Field of Search ..... 333/202, 203, 333/206, 222

[56] References Cited

U.S. PATENT DOCUMENTS

| | | | |
|---|---|---|---|
| 4,216,448 | 8/1980 | Kasuga et al. | 333/212 X |
| 4,267,537 | 5/1981 | Karmel | 333/212 X |
| 4,881,051 | 11/1989 | Tang et al. | 333/212 X |
| 5,139,328 | 8/1992 | Turunen | 333/202 |
| 5,192,926 | 3/1993 | Sogo et al. | 333/204 |
| 5,323,128 | 6/1994 | Ishizaki et al. | 333/204 |
| 5,345,202 | 9/1994 | Kobayashi et al. | 333/206 |
| 5,349,315 | 9/1994 | Ala-Kojola | 333/202 |
| 5,410,284 | 4/1995 | Jachowski | 333/203 X |
| 5,608,363 | 3/1997 | Cameron et al. | 333/219.1 X |

FOREIGN PATENT DOCUMENTS

| | | | |
|---|---|---|---|
| 2653856 | 2/1978 | Germany | 333/206 |
| 3041625 | 6/1982 | Germany | 333/212 |
| 89302 | 6/1982 | Japan | 333/202 DB |
| 238902 | 10/1991 | Japan | 333/206 |
| 6112704 | 4/1994 | Japan | 333/206 |

*Primary Examiner*—Benny Lee
*Attorney, Agent, or Firm*—Russell B. Miller; Roger W. Martin; Sean English

[57] ABSTRACT

A filter comprising a plurality resonator stages between sequentially coupled between input and output ports. The resonator stages are arranged such that at least one non-sequential pair of stages are physically adjacent. The non-sequential pair of resonator stages are separated by a common internal wall, which defines a bypass coupling aperture therebetween. During operation of the filter, attenuation poles are formed in the filter response due to bypass coupling between the non-sequential pair of resonator stages through the bypass coupling aperture. The preferred U-shaped arrangement of the resonator stages enables the formation of attenuation poles, without using an external bypass connection, by permitting inductive or capacitive bypass coupling through the bypass aperture.

6 Claims, 5 Drawing Sheets

DIELECTRIC FILTER HAVING INTRINSIC INTER-RESONATOR COUPLING

BACKGROUND OF THE INVENTION

I. Field of the Invention

The present invention relates to a compact dielectric filter disposed to be used within high frequency radio equipment, such as a portable telephone set. More particularly, the present invention relates to a unique dielectric filter architecture in which inter-resonator coupling is achieved without the use of extrinsic circuit elements.

II. Description of the Related Art

There exists an increasing demand for dielectric filters of more compact dimensions than typically characterize the conventional coaxial-type filter resonators widely used in high frequency communication devices. In a conventional $\lambda/4$ microwave resonance coaxial-type filter, a plurality of coaxial resonance conductors are successively coupled to each other.

Conventionally, a dielectric filter using one or more dielectric resonators is fabricated by attaching one-end short-circuited type coaxial resonators to capacitive-coupling electrodes formed on the surface of a dielectric filter substrate. The coaxial resonators may be constructed by providing a dielectric member having a through hole and an outer peripheral surface, both of which are coated with conductive material.

Dielectric filters are currently being designed particularly for incorporation within dual-band portable radiotelephones and other high-frequency communications devices. Specifically, these devices typically include an antenna duplexer for separating and combining signals having different frequencies. Such duplexers comprise a dielectric filter for transmission, and a dielectric filter for reception, which differ in center frequency. In this type of dielectric filter, the frequency interval between the center frequencies of transmitting and receiving bands becomes proportionately shorter at the high frequencies characteristic of mobile communications. This renders it more difficult to obtain the necessary out-of-passband attenuation, and requires the dielectric filter within the duplexer to have an attenuation pole within its transfer characteristic.

Attenuation poles may be formed in the frequency transfer characteristic of a dielectric filter having successively coupled resonance elements in order to meet filter attenuation specifications. Attenuation poles may also be used to improve the frequency response of higher-order resonator filters. Although high-order coupled resonator filters offer improved stopband attenuation, the passbands of such high-order filters tend to be "rounded" relative to lower-order filter passbands. Attenuation poles are sometimes formed at either end of the filter passband in order to flatten the passband response of high-order filters.

The poles are formed by providing an inductive or capacitive bypass between non-successive resonator stages. That is, a pair of resonators are directly connected by a reactive bypass element with at least one intervening resonator being "skipped" by the bypass connection. The bypass connection causes variation in the phase and amplitude of signal energy propagating through the filter, and is adjusted to provide the necessary phase difference required for pole formation.

This type of bypass construction undesirably results in increased filter dimensions, since it is typically implemented as a coaxial cable or the like external to the sequence of resonance elements. Moreover, the requirement that the bypass cable be physically coupled to each of the non-successive stages sets a minimum on the dimensions of each resonator stage.

In a particular type of conventional dielectric bandpass filter, an electrode pattern is provided on one of the side surfaces of a ceramic block. The electrode pattern allows coupling to a dielectric resonator and, in the case of multiple resonators, between adjacent resonators. The electrode pattern may be used to connect discrete components and inductance wires, which affects the filter transfer characteristic. Unfortunately, the coupling of discrete components to the exterior of the ceramic block makes the filter susceptible to damage. Moreover, additional processing may be required to apply a conductive cover to the block surface as a means of facilitating electrical connection to, and protection of, the external circuit components.

SUMMARY OF THE INVENTION

Accordingly, it is an object of the invention to provide a small-sized dielectric filter in which a bypass connection between non-successive resonator stages may be achieved without employing external circuit components.

It is another object of the invention to provide a compact dielectric filter in which desired passband filter characteristics are obtained through the creation of one or more attenuation poles through intrinsic inter-resonator coupling.

In summary, these and other objects are met by an improved dielectric filter with intrinsic inter-resonator coupling. The dielectric filter of the invention comprises a plurality of resonator stages sequentially coupled between input and output ports. The resonator stages are arranged such that at least one non-sequential pair of resonator stages are physically adjacent. The non-sequential pair of resonator stages are separated by a common internal wall, which defines a bypass coupling aperture therebetween. During operation of the filter, attenuation poles are formed in the filter response due to bypass coupling between the non-sequential pair of resonator stages through the bypass coupling aperture. The preferred U-shaped arrangement of the resonator stages enables the formation of attenuation poles, in the absence of an external bypass connection, by permitting inductive or capacitive bypass coupling through the bypass aperture.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1A:
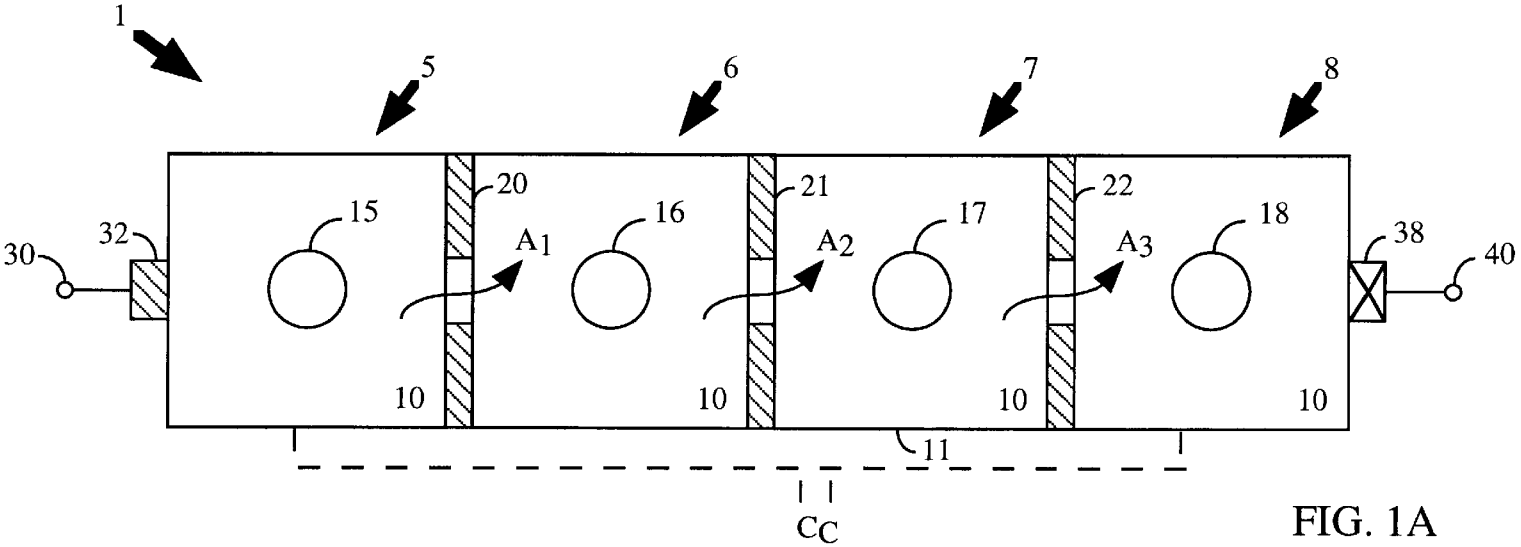
FIG. 1A provides an overhead sectional view of a conventional bandpass, cavity filter constituted by four coaxial resonators.

FIG. 1A provides an overhead sectional view of a conventional bandpass dielectric filter 1 constituted by four coaxial cavity resonators 5,6,7,8. Each coaxial resonator 5,6,7,8 is made of a ceramic body 10, generally in the form of a solid block. Each ceramic body 10 may, however, be hollowed if it is desired that an air dielectric be included within each coaxial resonator 5,6,7,8. All the surfaces of the body 10 are coated with an electrically conductive cover 11. Each of the resonators 5,6,7,8 is a $\lambda/4$ one-end short-circuited type dielectric-loaded resonator formed by coating the interior surface of a longitudinal hole within the body 10 with conductive material, thereby forming center coaxial conductors 15,16,17,18. As is indicated by the side sectional view of FIG. 1B, each center coaxial conductor 15,16,17,18 is contiguous with the conductive cover 11 on the lower surface of the dielectric body 10. The outer conductor of each resonator 5,6,7,8 is partly defined by the conductive cover 11, and is partly defined by one of the conductive interior walls 20,21,22. The resonators 5,6,7,8 are coupled with each other through apertures A1,A2,A3 in conductor cover 11 respectively defined by the conductive interior walls 20,21,22. Resonators 5,6,7,8 are typically coupled to one another by soldering of the conductive layer 11 at walls 20,21,22. In some instances an air gap may be formed at apertures A1,A2,A3.

In an alternative embodiment, filter 1 may be formed from an integrally formed ceramic body. In this instance a saw cut or other means formed slots are created in the body. Such manufacture forms the individual resonators and apertures A1,A2,A3. Again longitudinal hole is formed as discussed previously in each resonator. Along with the exterior surface of the body, the slots are filled with the material forming conductive over 11 to form interior walls 20,21,22.

Figure 1B:
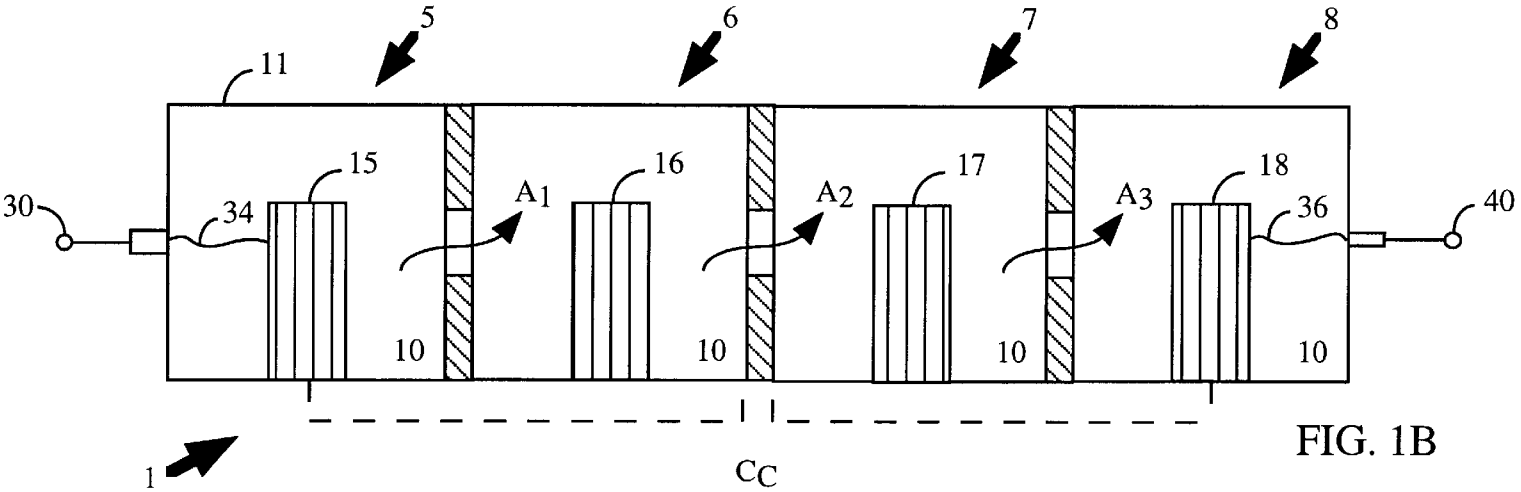
FIG. 1B PRIOR ART
FIG. 1B is a side sectional view of the conventional bandpass, cavity filter shown in FIG. 1A.
Figure 1C:
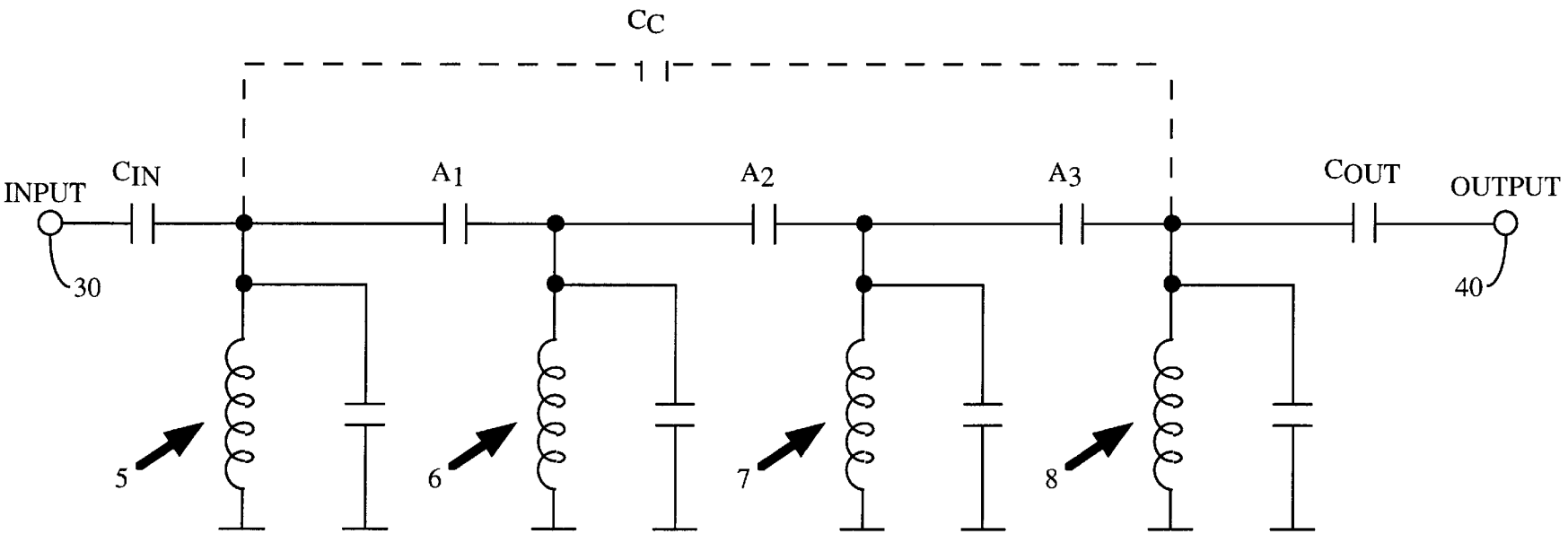
FIG. 1C is an equivalent circuit representation of a cavity resonator filter in which capacitive coupling is used to form transmission zeroes.

An input signal at input terminal 30 (see FIGS. 1A, 1B) is impressed upon the center conductor 15 of the first resonator 5 through a bonding pad 32 (see FIG. 1A) and input coupling wire 34 (see FIG. 1B). Similarly, the output of the filter 1 (see FIGS. 1A, 1B) is tapped from the center conductor 18 of the fourth resonator 8 by way of output coupling wire 36 (see FIG. 1B) and bonding pad 38 (see FIG. 1A), which is connected to output terminal 40 (see FIGS. 1A, 1B). In alternate embodiments the output of the filter 1 may be tapped using a capacitive probe. FIG. 1C is a schematic diagram showing an equivalent circuit of the dielectric resonator depicted in FIGS. 1A and 1B. In particular, the coaxial resonators 5, 6, 7, 8 are each represented by a parallel LC circuit, with the coupling through apertures A1, A2, A3 between successive pairs of resonators being represented by capacitors. Filter input 30 and filter output 40 are capacitively coupled through $C_{IN}$ and $C_{OUT}$, respectively.

As is indicated by FIGS. 1A and 1B, the resonators 5,6,7,8 are linearly arranged between the input terminal 30 and output terminal 40. As was mentioned in the Background of the Invention, it is known to form attenuation poles in the frequency characteristic curve of a filter having successively coupled resonance elements. The attenuation poles may serve to flatten passband response, or may serve to suppress specific frequency components such as a leakage of a local oscillator. Attenuation poles may be formed by creating a bypass connection between "non-sequential" resonators (e.g., resonators 5 and 8), using a coaxial cable or the like. In FIGS. 1A and 1B, this optional bypass connection is represented in phantom as the coupling capacitance $C_c$ (also see FIG. 1C). Unfortunately, this type of external bypass connection increases filter size and complexity, and renders the filter 1 susceptible to damage.

Figure 2A:
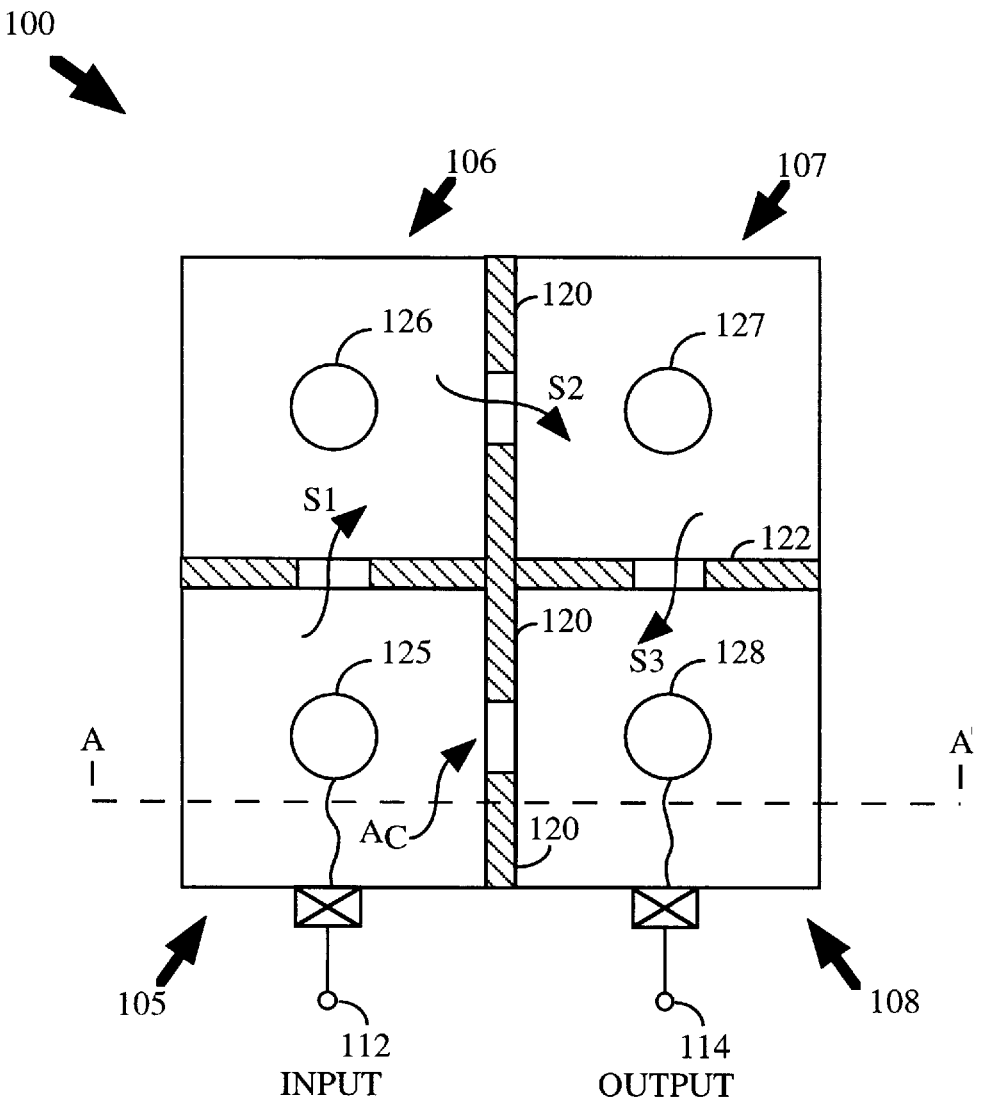
FIG. 2A provides a top sectional view of a bandpass resonator filter in accordance with the present invention.

Turning now to FIG. 2A, a top sectional view is provided of a bandpass resonator filter 100 in accordance with the present invention. The resonator filter 100 is seen to be comprised of first through fourth coaxial cavity resonators 105,106,107,108 arranged in a "U-shaped" pattern between an input terminal 112 and an output terminal 114. The filter 100 includes an electrically conductive cover 118 (see FIGS. 2B, 2C), which defines a portion of the outer conductors of each of the coaxial cavity resonators 105,106,107,108. The remainder of each resonator outer conductor is formed by a first interior common wall 120, and by a second interior common wall 122 transverse thereto both formed of an electrically conductive material. Each of the cavity resonators 105,106,107,108 respectively includes a slightly less than $\lambda/4$ one-end short-circuited center conductor 125,126, 127,128, it being understood that the filter of the invention could be implemented using a variety of resonator types (e.g., rectangular bar, round rod, or "inside-plated" hole). For example, the interior of each resonator 105,106,107,108 could be loaded with a dielectric material so as to form a dielectric filter having dielectric resonator stages of the type depicted in FIGS. 1A and 1B. As is indicated by FIG. 2A, sequential ones of the resonators 105,106,107,108 (e.g., first and second resonators 105,106) are coupled with each other through the slot apertures S1,S2,S3, defined by the conductive interior common walls 120 and 122.

Figure 2B:
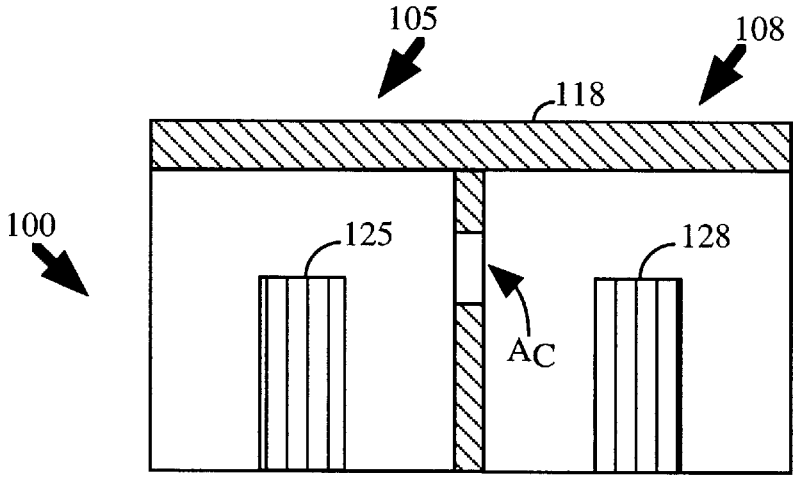
FIG. 2B is a side sectional view of the inventive filter shown in FIG. 2A.
Figure 2C:
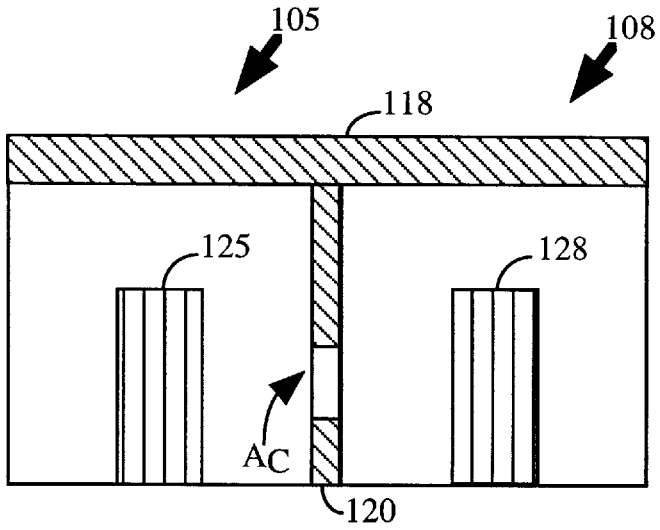
FIG. 2C is another side sectional view of the inventive filter shown in FIG. 2A.

FIG. 2B is a side sectional view of the filter 100 taken along the plane perpendicular to line segment A—A' (FIG. 2A). Referring to FIG. 2B, the center conductors 125 and 128 (as well as the conductors 126 and 127 which is not shown herein) are contiguous with a lower surface of the conductive housing 118. In accordance with the invention, inter-resonator coupling between the "non-sequential" first and fourth resonators 105 and 108 is effected through a bypass coupling aperture $A_c$ defined by the interior common wall 120. The bypass aperture $A_c$ will typically be much smaller than the slot apertures S1,S2,S3, since it is intended to serve only as a small bypass reactance between the resonators 105 and 108. In FIG. 2B, the bypass aperture $A_c$ effects capacitive coupling by virtue of being defined by an upper portion of the common wall 120 proximate the open-circuited ends of the center conductors 125 and 128. In the side sectional view of FIG. 2C, the bypass aperture $A_c$ provides inductive coupling as a consequence of being located in a lower region of the common wall 120 near the short-circuited ends of the center conductors 125 and 128.

The bypass aperture $A_c$ advantageously obviates the need for an external bypass connection (see, e.g., coupling capacitance $C_c$ of FIG. 1B) as a means of achieving coupling between non-sequential resonator stages. This feature of the present invention enables the realization of compact resonator filters in which attenuation poles may be formed without employment of external circuit elements.

Figure 3:
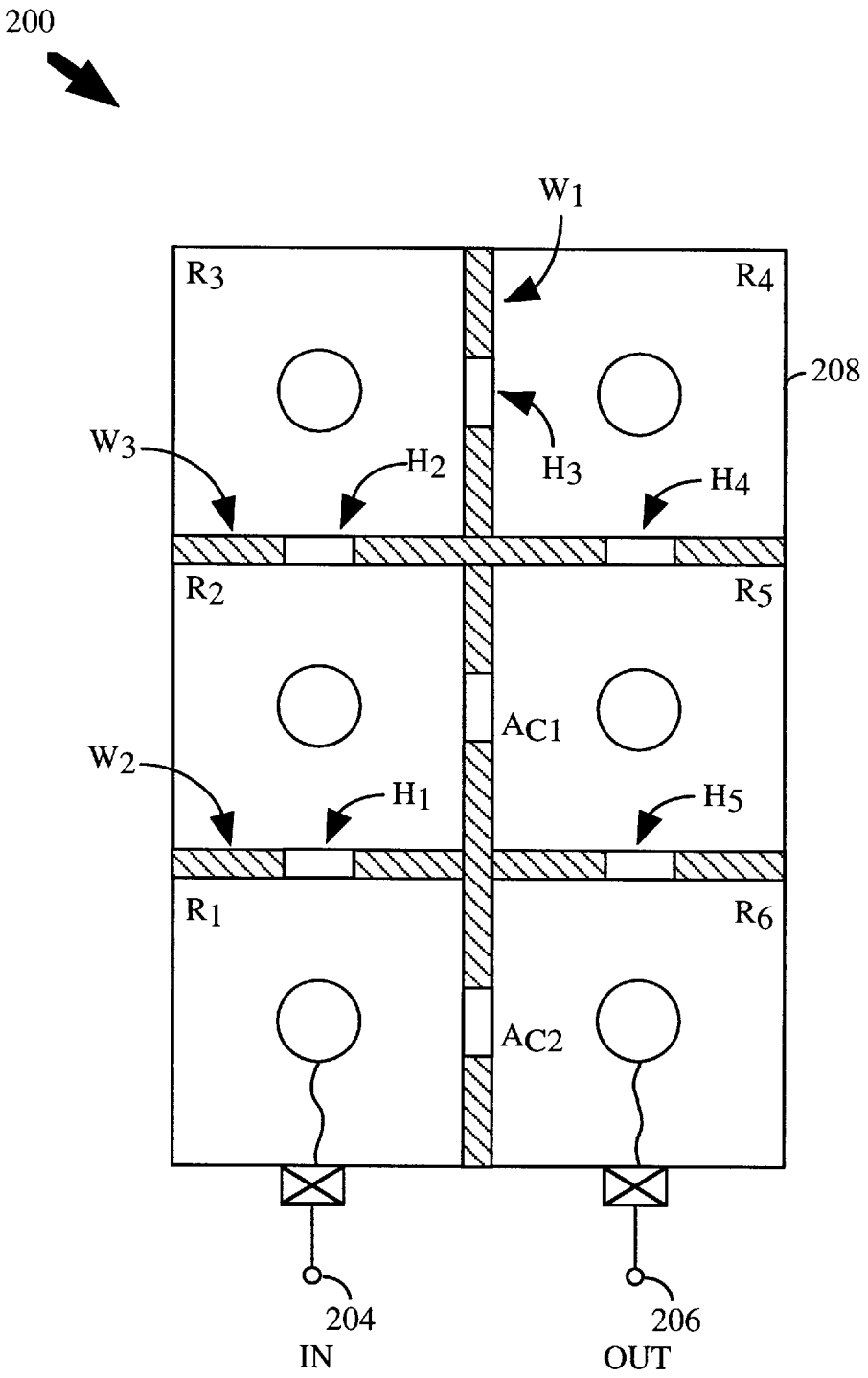
FIG. 3 depicts a top sectional view of a six-stage bandpass filter of the present invention.

FIG. 3 depicts a top sectional view of a six-stage bandpass filter 200 of the present invention. The resonator filter 200 of FIG. 3 is substantially similar to the filter 100 (FIGS. 2A–2C), but includes six sequential cavity resonators R1,R2,R3,R4,R5,R6 arranged in a "U-shaped" pattern between an input terminal 204 and an output terminal 206. The filter 200 includes a conductive housing 208, which defines a portion of the outer conductors of each of the coaxial cavity resonators R1,R2,R3,R4,R5,R6. The remainder of each resonator outer conductor is formed by interior common walls W1,W2,W3, which also define coupling holes H1,H2,H3,H4,H5 through which sequential ones of the resonators R1,R2,R3,R4,R5,R6 are coupled to each other. The resonators R1,R2,R3,R4,R5,R6 may comprise, for example, either air-filled cavity resonators or dielectric-loaded coaxial resonators.

In the embodiment of FIG. 3, inter-resonator coupling is achieved between the non-sequential pair of resonators R2 and R5 through a first bypass coupling aperture $A_{c1}$ defined by the common wall W1, and between non-sequential resonators R1 and R6 through a second bypass coupling aperture $A_{c2}$ defined by the common wall W1. Again, the bypass apertures $A_{c1}$ and $A_{c2}$ may be formed so as to provide either inductive or capacitive bypass coupling.

The previous description of the preferred embodiments is provided to enable any person skilled in the art to make or use the present invention. The various modifications to these embodiments will be readily apparent to those skilled in the art, and the generic principles defined herein may be applied to other embodiments without the use of inventive faculty. Thus, the present invention is not intended to be limited to the embodiments shown herein but is to be accorded the widest scope consistent with the principles and novel features disclosed herein.

I claim:

1. A dielectric filter comprising:

a plurality of dielectric resonators arranged in a sequential order, each of said resonators being physically adjacent to at least two other of said resonators;

a plurality of common walls between adjacent resonators;

at least one coupling aperture for coupling adjacent sequential resonators, said at least one coupling aperture disposed within respective ones of said plurality of common walls;

at least one bypass aperture for coupling adjacent non-sequential resonators, said at least one bypass aperture disposed within respective ones of said plurality of common walls; and wherein each of said plurality of dielectric resonators comprises a respective body of dielectric material and a corresponding center conductor, said respective center conductor being positioned within said corresponding dielectric resonator and electrically short circuited to a respective one of said plurality of common walls.

2. The dielectric filter of claim 1 wherein said plurality of dielectric resonators are arranged in a U-shaped pattern.

3. The dielectric filter of claim 2 wherein said plurality of dielectric resonators each comprise a respective coaxial resonator having an outer peripheral conductor shared with at least two other of said plurality of resonators, and a respective inner conductor separated from said corresponding outer peripheral conductor by a respective dielectric material.

4. A coaxial resonator filter comprising:

a plurality of coaxial resonators arranged in a sequential order, each of said resonators being physically adjacent to at least two other of said resonators;

a plurality of common walls between adjacent resonators;

at least one coupling aperture for coupling adjacent sequential resonators, said at least one coupling aperture disposed within respective ones of said plurality of common walls;

at least one bypass aperture for coupling adjacent non-sequential resonators, said at least one bypass aperture disposed within respective ones of said plurality of common walls; and wherein each of said plurality of coaxial resonators comprises a respective body of ceramic material and a corresponding center conductor, said respective center conductor being positioned within said corresponding dielectric resonator and electrically short circuited to a respective one of said plurality of common walls.

5. A coaxial resonator filter of claim 4 comprising four coaxial resonators.

6. A coaxial resonator filter of claim 4 comprising six coaxial resonators.

* * * * *